US005448811A

United States Patent [19]

Jaeger et al.

[11] Patent Number: 5,448,811

[45] Date of Patent: Sep. 12, 1995

[54] DROP-WIRE SEPARATION DEVICE FOR WARP DRAWING-IN MACHINES

[75] Inventors: Silvio Jaeger, Mauren, Liechtenstein; Heinrich Steiner, Sargans; Philipp Gartmann, Fläsch, both of Switzerland

[73] Assignee: Zellweger Luwa AG, Uster, Switzerland

[21] Appl. No.: 146,034

[22] PCT Filed: Mar. 10, 1993

[86] PCT No.: PCT/CH93/00062

§ 371 Date: Nov. 4, 1993

§ 102(e) Date: Nov. 4, 1993

[87] PCT Pub. No.: WO93/18215

PCT Pub. Date: Sep. 16, 1993

[30] Foreign Application Priority Data

Mar. 11, 1992 [CH] Switzerland ..... 00791/92

[51] Int. Cl.[6] ..... D03J 1/14

[52] U.S. Cl. ..... 28/205; 28/206; 139/351

[58] Field of Search ..... 28/205, 208, 206; 271/24; 139/351

[56] References Cited

U.S. PATENT DOCUMENTS

| | | | |
|---|---|---|---|
| 3,743,276 | 7/1973 | van der Does . | |
| 4,815,498 | 3/1989 | Gryson et al. | 139/351 |
| 5,148,585 | 9/1992 | Jaeger . | |
| 5,174,000 | 12/1992 | Wilhelm et al. | 28/205 |

FOREIGN PATENT DOCUMENTS

| | | |
|---|---|---|
| 0448957 | 10/1991 | European Pat. Off. . |
| 0457145 | 11/1991 | European Pat. Off. . |
| 0481183 | 4/1992 | European Pat. Off. . |
| 7108305 | 12/1972 | Netherlands . |
| WO91/05099 | 4/1991 | WIPO . |
| WO92/05303 | 4/1992 | WIPO . |

*Primary Examiner*—Andrew M. Falik

*Attorney, Agent, or Firm*—Burns, Doane, Swecker & Mathis

[57] ABSTRACT

A separation device for a warp drawing-in machine contains a dividing-off member for dividing off the foremost dropwire of a drop-wire stack. This dividing-off member includes a separating device and a transport device. The separating device subjects to pressure one of the end edges of the dropwire to be divided off to thereby bend this dropwire outwards. The transport device is provided for entry into the gap formed as a result of the outward bending of the dropwire and for conveying the separated dropwire away from the stack. With this separation device, all types of dropwires can be individually separated easily and at a high frequency.

18 Claims, 5 Drawing Sheets

DROP-WIRE SEPARATION DEVICE FOR WARP DRAWING-IN MACHINES

FIELD OF THE INVENTION

The present invention relates to a drop-wire separation device for warp drawing-in machines, having a dividing-off member for the respective foremost drop-wire of a drop-wire stack.

BACKGROUND OF THE INVENTION

European Patent Application No. 91 113 484.9 describes a drop-wire separation device, in which the dividing-off member is formed by a friction wheel which is pressed against the foremost dropwire and which pushes the latter out of the stack in the longitudinal direction into an intermediate position, in which the dropwire is grasped by a transport means and separated completely from its stack by this. In this separation device, problems can arise if the dropwires cannot slide undisturbed on one another. The latter occurs especially when the dropwires have burrs in the region of their yarn eyelet or any slide-inhibiting residues on their surface.

SUMMARY OF THE INVENTION

Now the invention is to provide a drop-wire separation device, by means of which all types of dropwires can be divided off, including especially those which do not have surfaces with good slidability.

The set object is achieved, according to the invention, in that the dividing-off member comprises a separating means which subjects one of the end edges of the dropwire to be divided off to pressure and which thereby bends this dropwire outwards, and a transport means provided for entry into the gap formed between the respective dropwire and the stack as a result of the outward bending.

The separating operation proceeds in that the separating means presses from above onto the upper end edge of the dropwire to be divided off, the lower end edge of which bears against a stop. The dropwire is thereby compressed between the separating means and the stop in the same way as with tongs and is bent outwards and forms a convex curve in relation to the drop-wire stack. The transport means can then move laterally into the interspace between the drop-wire stack and this curve and subsequently, by means of a movement in the longitudinal direction of the drop-wire stack, feed the divided-off dropwire to a holding member which positions the dropwire for the drawing in of the warp. This guarantees a reliable separation of the dropwires, which is virtually independent of the surface quality of the dropwires and which functions reliably even when burrs and the like are present.

BRIEF DESCRIPTION OF THE DRAWING FIGURES

The invention is explained in more detail below by means of an exemplary embodiment and the drawings; in these:

DETAILED DESCRIPTION OF THE PREFERRED EMBODIMENT

Figure 1:
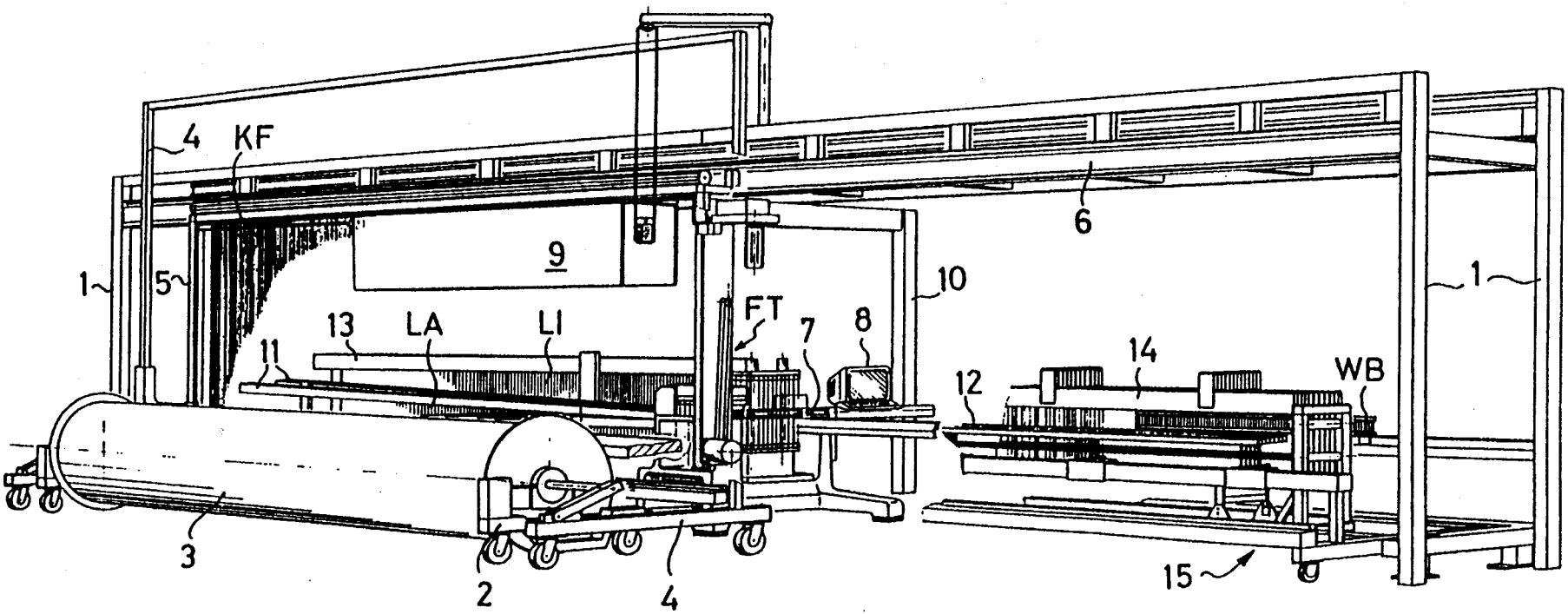
FIG. 1 shows a general perspective representation of a warp drawing-in machine.

According to FIG. 1, the drawing-in machine consists of a basic stand 1 and of various subassemblies which are arranged in this and which each form a functional module. A warp-beam carriage 2 having a warp beam 3 arranged on it can be seen in front of the basic stand 1. The warp-beam carriage 3 moreover contains a lifting device 4 for mounting a yarn frame 5, on which the warp yarns KF are stretched. This stretching takes place before the actual drawing in and at a location separate from the drawing-in machine, the yarn frame 5 being positioned at the lower end of the lifting device 4 in direct proximity to the warp beam 3. For the drawing in, the warp-beamcarriage 2 together with the warp beam 3 and lifting device 4 is moved up to the so-called setting-up side of the drawing-in machine, and the yarn frame 5 is lifted upwards by the lifting device 4 and suspended in the basic stand 1, where it then assumes the position shown.

The yarn frame 5 can be displaced in the longitudinal direction of the basic stand 1 by means of a drive which is not shown. During this displacement, the warp yarns KF are guided past a yarn-separating unit 6 forming part of a so-called yarn module and are thereby separated and divided off. After the dividing off, the warp yarns KF are cut off and presented to a drawing-in needle 7 which forms an integral part of the so-called drawing-in module. For dividing off the warp yarns, for example the dividing-off device used in the warp-tying machine USTER TOPMATIC (USTER—registered trademark of Zellweger Uster AG) can be employed.

Next to the drawing-in needle 7 can be seen a video display unit 8 which belongs to an operating station and which serves for indicating machine functions and machine malfunctions and for data input. The operating station, which forms part of a so-called programming module, also contains an input stage for the manual input of particular functions, such as, for example, crawling speed, start/stop, repetition of operations, and the like. The drawing-in machine is controlled by a control module which contains a control computer and which is arranged in a control box 9. This control box contains, in addition to the control computer, a module computer for each so-called main module, the individual module computers being controlled and monitored by the control computer. The main modules of the drawing-in machine, in addition to the modules already mentioned, namely the drawing-in module, yarn module, control module and programming module, are also the heald, dropwire and reed modules.

The yarn-separating unit 6, which presents to the drawing-in needle 7 the warp yarns KF to be drawn in, and the path of movement of the drawing-in needle 7, which runs vertically relative to the plane of the stretched warp yarns KF, define a plane which is located in the region of a post 10 forming part of the basic stand which past separates the already mentioned setting-up side from the so-called stripping-off side of the drawing-in machine. The warp yarns and the individual elements, into which the warp yarns are to be drawn, are supplied on the setting-up side, and the so-called harness (healds, dropwires and reed) together with the drawn-in warp yarns can be removed on the stripping-off side. During the drawing in, the yarn frame 5 together with the warp yarns KF and the warp-beam carriage 2 together with the warp beam 3 are moved past the yarn-separating unit 6 to the right, the drawing-in needle 7 successively removing from the frame 5 the warp yarns KF stretched on this.

When all the warp yarns KF are drawn in and the yarn frame 5 is empty, the latter, together with the warp-beam carriage 2, the warp beam 3 and the lifting device 4, is located on the stripping-off side and can be removed from the basic stand 1.

Directly behind the plane of the warp yarns KF are arranged the warp stop-motion dropwires LA, behind these the healds LI and, even further behind, the weaving reed. The dropwires LA are stacked in hand magazines, and the full hand magazines are suspended in feed rails 11 which are arranged at an inclination and on which they are transported to the right towards the drawing-in needle 7. There, they are separated and brought into the drawing-in position. After the drawing in has taken place, the dropwires LA pass on drop-wire carrier rails 12 onto the stripping-off side.

The healds LI are lined up in rows on rails 13 and are displaced manually or automatically on these to a separating stage. The healds LI are then brought individually into their drawing-in position and, after drawing in has taken place, are distributed to the corresponding heald frames 14 on the stripping-off side. The weaving reed is likewise moved in steps past the drawing-in needle 7, the corresponding reed gap being opened for the drawing in. After the drawing in, the reed is likewise located on the stripping-off side. Part of the weaving reed WB can be seen on the right next to the heald frames 14. This representation is to be understood as being purely illustrative, because, when the frame 5 is in the position shown, the weaving reed is of course located on the setting-up side.

As can also be taken from the figure, on the stripping-off side there is a so-called harness carriage 15. This, together with the drop-wire carrier rails 12 fastened on it, heald frames 14 and a mounting for the weaving reed, is pushed into the basic stand 1 into the position shown and, after the drawing in, carries the harness together with the drawn-in warp yarns KF. At this moment, the warp-beam carriage 2 together with the warp beam 3 is located directly in front of the harness carriage 15. The harness is then transferred by means of the lifting device 4 from the harness carriage 15 onto the warp-beamcarriage 2 which then carries the warp beam 3 and the drawn-in harness and which can be moved up to the respective weaving machine or into an intermediate store.

The functions described are distributed to a plurality of modules constituting virtually independent machines which are controlled by the common control computer. The cross-connections between the individual modules run by way of this overriding control computer, and there are no direct cross-connections between the individual modules. The already mentioned main modules of the drawing-in machine are themselves again of modular construction and, as a rule, consist of part modules.

Figure 2:
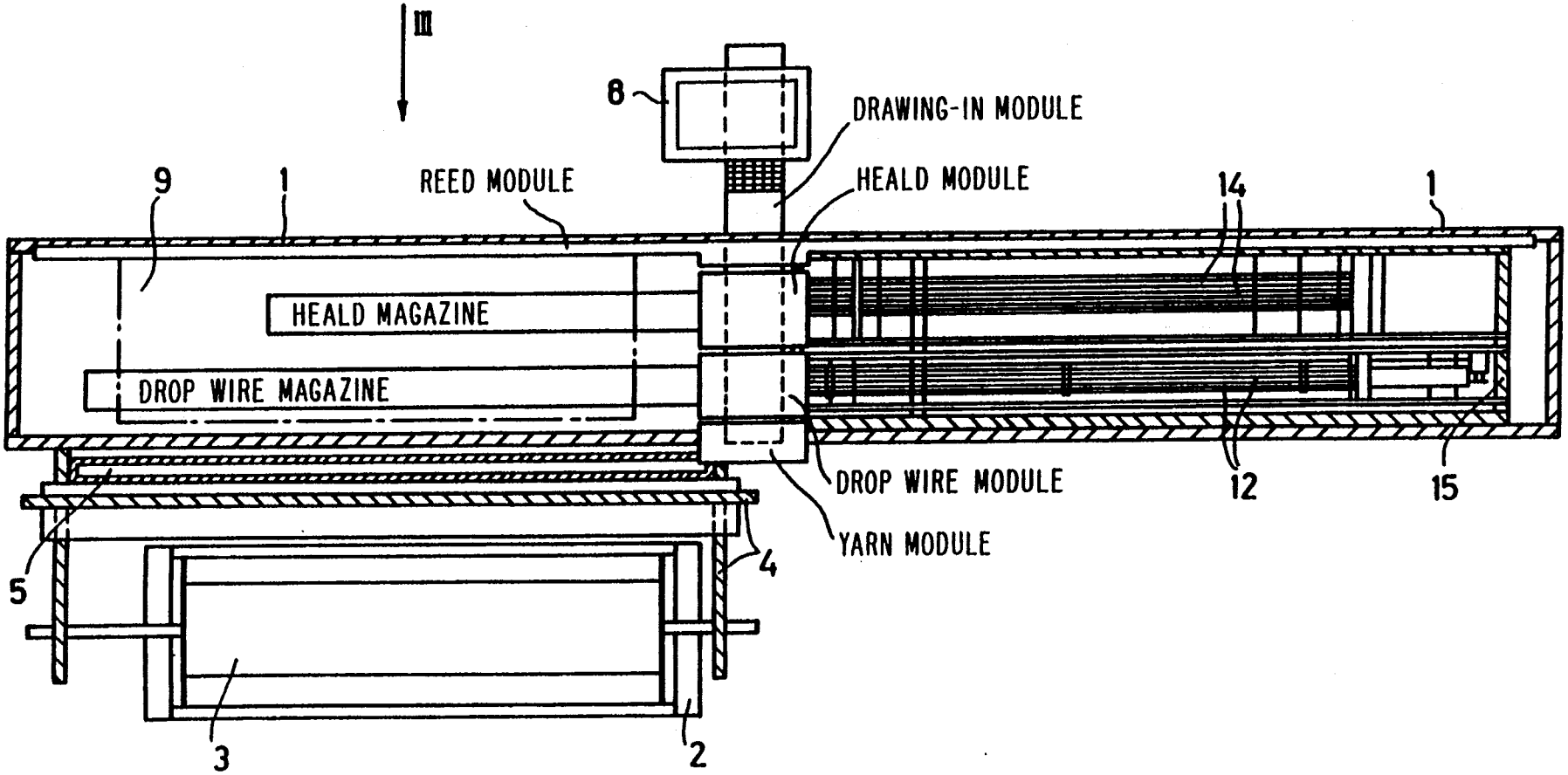
FIG. 2 shows a diagrammatic top view of the drawing-in machine of FIG. 1.

This modular construction, which is described in WO-A-91/05099, can be seen especially clearly from the representation of FIG. 2. FIG. 2 shows the basic stand 1, the warp-beamcarriage 3 together with the warp beam 2, the lifting device 4 and the yarn frame 5, which are coupled together with the warp-beam carriage 3, the yarn module, the drop-wire module, the heald module, the reed module, the operating station with the video display unit 8, the drawing-in module, the control box 9, the heald-magazine part module with the rails 13, the drop-wire magazine part module with the feed rails 11, and the harness carriage 15 with the drop-wire carrier rails 12 and heald frames 14.

The drop-wire magazine part module is described in EP-A-0,457,145. It can be taken from this patent application that the drop-wire magazine part module consists essentially of an elongate stand, in which the feed rails 11 for the hand magazines containing the dropwires are mounted. Said hand magazines are loaded with dropwires and are suspended in the feed rails 11, in which they are transported towards a separating station for the individual separation of the dropwires. This separation station will now be described with reference to FIGS. 3 to 5.

As represented, the separating station has the form of a straight rectangular prism with two compartments separated by an intermediate plate 16, namely the actual separating part ST at the top and its driving part AT at the bottom, the intermediate plate 16 forming the bottom of the separating part ST. The separating station is carried by a baseplate 17 which is itself displaceable in a slide-like manner on a carrier plate 18 fastened to the machine stand. For this purpose, there are mounted on the carrier plate 18 two webs 19, in which two spaced shafts 20 are supported. On these are mounted displaceably two webs 21 connected to the baseplate 17. In the region of one of the two webs 21, an adjustable stop and/or a detent, which is not shown, is provided for adjusting and fixing the working position of the separating unit.

Fastened to the baseplate 17 are two vertical guide rods 22 and 23, on which the intermediate plate 16 and a cover plate 24 closing off the separating station at the top are mounted so as to be vertically adjustable and fixable. Thus, on the one hand, the separating part ST is vertically adjustable, and on the other hand, the spacing between the intermediate plate 16 and the cover plate 24 is also adjustable and can therefore be set to different types of dropwire. Arranged on the baseplate 17 in addition to the two guide rods 22 and 23 are a motor 25 and a gear unit 27 driven by the latter via a driving belt 26, said gear unit 27 also containing, in addition to a mechanical gear, a pneumatic part which serves for driving the various pneumatically driven parts of the separating station.

The end face of the separating station, on the left in the figures, is provided as an input side and the right-hand end face as an output side for the dropwires. On the input side, the dropwires are pushed from the hand magazines of the drop-wire magazine part module into the separating station, and on the output side the separation of the dropwires from their stack LS is carried out, the individual dropwires being output sequentially from the separating station. The separating station is connected, on its input side, to the stand forming the drop-wire magazine part module and described in EP-A-0,457,145. As can be taken from this patent application, said stand has a central longitudinal rail, on which are articulated, among other things, pivoting rails for guiding the hand magazines, which serve selectively for feeding the hand magazines to the separating station or for returning them from this. At the end of the longitudinal rail of said stand which confronts the separating station is provided a coupling for releasable connection to the separating station. This coupling contains a claw-shaped coupling strap KL (FIG. 5) which can be fastened to the guide rod 23.

Figure 3:
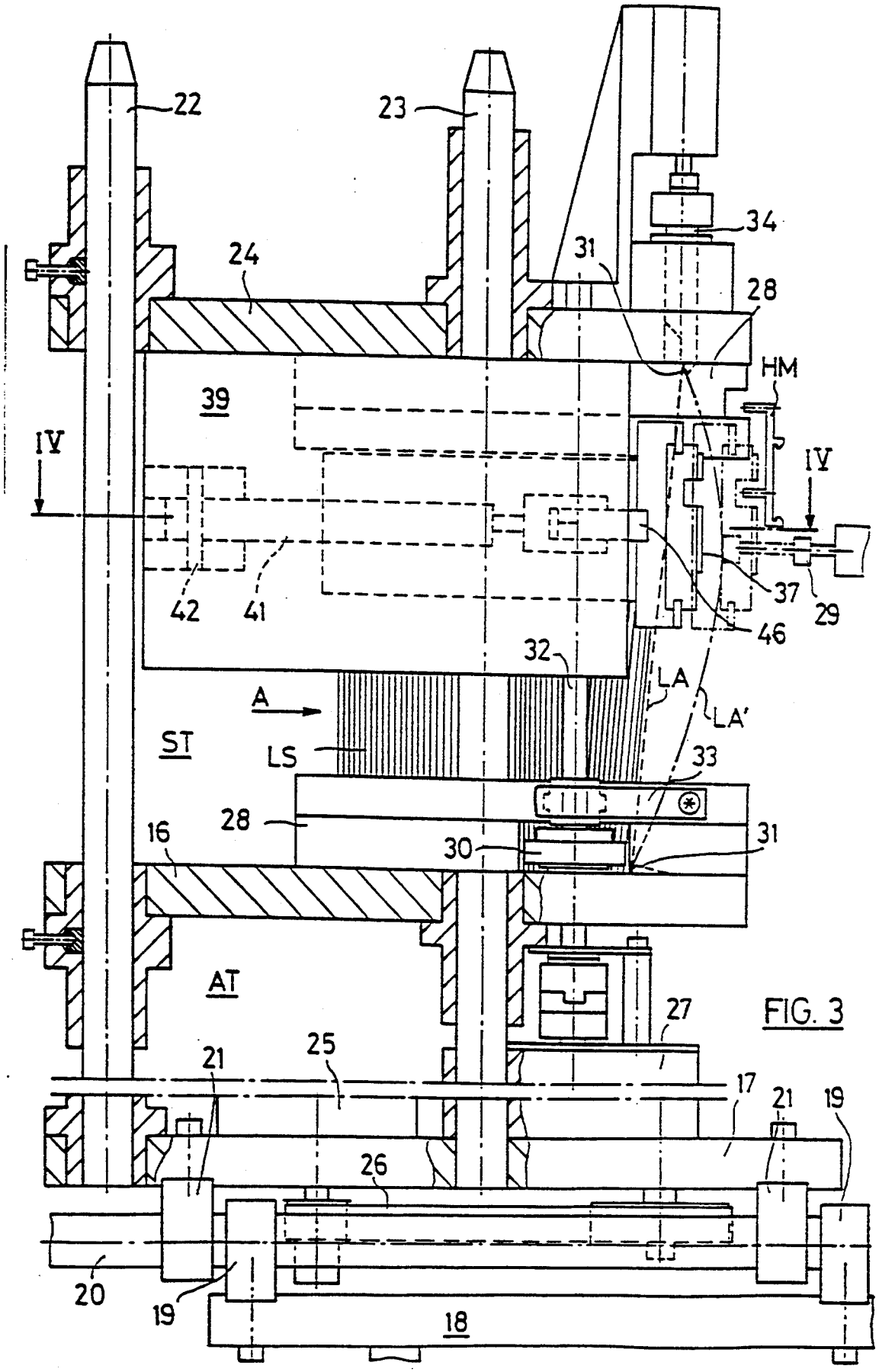
FIG. 3 shows a side view of a drop-wire separation device according to the invention.
Figure 4:
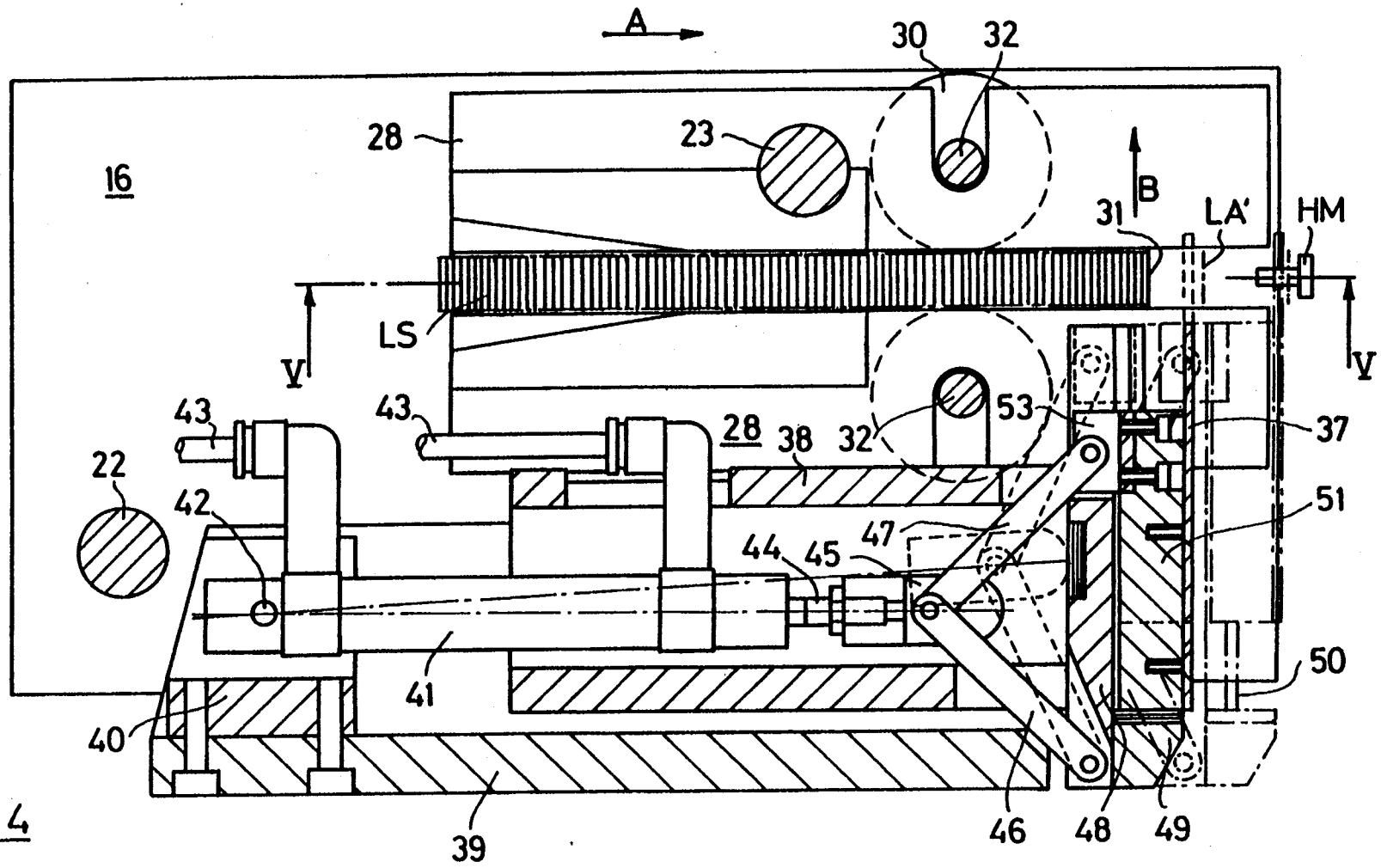
FIG. 4 shows a section along the line IV—IV of FIG. 3.

On the output side of the separating station is arranged a so-called drop-wire distribution module of the type described in the International Patent Application PCT/CH 91/00190. This contains, among other things, a toothed belt which rotates in a horizontal plane and to the outside of which are fastened holding means intended for the dropwires and consisting of a small plate having two supporting pins arranged vertically one below the other. A small plate of this type is shown in FIG. 3 and is designated by the reference symbol HM.

A pair of guide rails 28 is screwed respectively to the cover plate 24 and to the intermediate plate 16 on the mutually confronting inner faces of these plates. Between the guide rails is a channel which is somewhat wider than the dropwires and in which the dropwires LA are displaced towards the output side as far as rotating transport brushes 30. The latter serve as a conveying device to displace the dropwires, coming into their effective range, in the transport direction (arrow A) as far as a stop.

The stop is formed by a respective step 31 in the channels present between the guide rails 28, the upper step 31 at the cover plate 24 being displaced relative to the lower step 31 at the intermediate plate 16 in the transport direction A, so that the foremost dropwires of the stack LS are inclined obliquely forwards. This position is indicated in FIG. 3 by a dropwire LA marked by a broken line.

The transport brushes 30 are mounted on the vertical drive shafts 32 which are connected to the gear unit 27 via a suitable coupling, in such a way that the transport brushes 30 have lateral play and are adjustable relative to the drop-wire stack in the channel formed between the guide rails 28. There engages respectively on the side of the drive shaft 32 which is the outer in relation to said channel a leaf spring 33 which presses the drive shaft 32 and therefore also the transport brushes 30 fastened to this laterally against the drop-wire stack.

The separation of the respective foremost drop-wire LA from its stack LS is carried out by means of a pneumatically drivable separating plunger 34 (FIG. 4) which presses from above against the upper end edge of the dropwire and which is fastened to the cover plate 24. As can be taken from FIG. 4, the separating plunger 34 is flattened in the region of its free end and is guided with this flattening on a guide 35 which is located somewhat above the bottom of the channel formed between the guide rails 28. The separating plunger projects beyond the guide 35 with a dividing-off nose 36 which is stepped relative to the flattening and which forms the step 31 acting as a stop for the dropwires between the upper guide rails 28. The depth of the stepping of the dividing-off nose 36 from the flattening depends on the drop-wire thickness and is respectively somewhat smaller than this. Different separating plungers 34 are accordingly used for different drop-wire thicknesses.

For dividing off the foremost dropwire, the separating plunger 34 is moved a few, approximately 3 to 5, millimetres downwards, the stepping between the dividing-off nose 36 and the flattened part of the separating plunger pressing the dropwire downwards. Since the latter cannot escape, it is bent outwards and acquires a convex curve in relation to the drop-wire stack LS, as shown in the position LA' marked in FIG. 3 by broken lines.

In this position, the dropwire is fixed between the steps 31 and cannot escape. The inclination of the dropwires prevents the foremost dropwire from sliding away under the separating plunger 34 during the dividing off. This risk is present with thick dropwires, in which the drop-wire head subjected to pressure by the separating plunger 34 attempts to escape towards the drop-wire stack. Practical trials have shown that this escape is prevented completely by the inclination of the dropwires.

Figure 5:
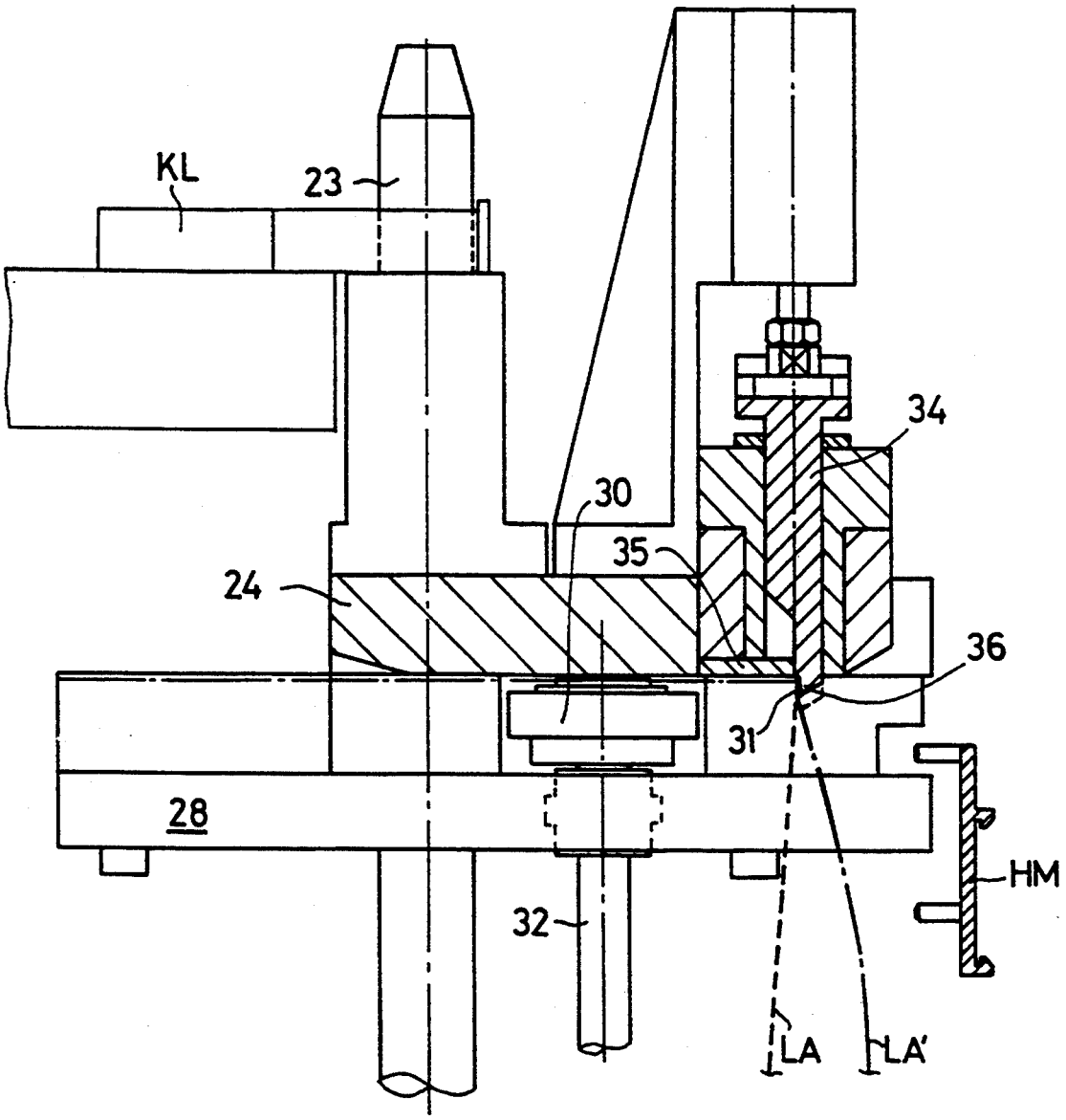
FIG. 5 shows a section along the line V—V of FIG. 4.

When the drop-wire position LA' is reached and a gap is thereby formed between the drop-wire stack LS and the dropwire bent outwards from this, the first phase of the dividing-off operation is concluded, and there takes place in a second step the removal of the dropwire from the stack and its transfer to the holding means HM of the drop-wire distribution module via transport means formed by a controlled slide 37 (FIG. 5). The slide executes essentially a two-stage movement, specifically it is moved first in the direction of the arrow B into the gap between the dropwire L' bent outwards and the drop-wire stack LS and subsequently in the direction of the arrow A towards the holding means HM.

Fastened to the lower side of the cover plate 24 are a tube 38 and a masking plate 39 which itself carries a bearing web 40 for a pressure cylinder 41. This is mounted pivotably at its rear end about an axis 42 and projects with its front end into the tube 38. The pressure cylinder 41 is equipped with compressed-air connections 43, of which one serves for the forward movement and the other for the rearward movement of a piston carrying a piston rod 44.

Fastened to the free end of the piston rod 44 is a bearing head 45, on which two lever arms 46 and 47 are mounted about a common pivot axis. The lever arm 46 is connected in an articulated manner at its free end to a plate 48 which is fastened to the right-hand end face of the tube 38 and on which is fastened a vertical web 49 carrying bearing pins 50 which are oriented in the direction of the arrow B and on which a sliding part 51 is mounted displaceably. This sliding part 51, which serves as a carrier for the slide 37, is connected to a sliding block 53 which is guided in guides 52 arranged on the plate 48 and is articulated on the free end of the lever 47 and which is itself screwed to the sliding part 51.

The connecting point formed between the lever 46 and the plate 48 by a pivot pin is guided in a slot such that it initially remains fixed in place during the movement of the piston rod 44 together with the bearing head 45 out of the position of rest, represented by unbroken lines in FIG. 5, to the right in the direction of the arrow A. The result of this is that the two levers 46 and 47 are spread apart, and that the pressure cylinder 41 is pivoted about the axis 42, until finally the bearing head 45 and the levers 46 and 47 assume the position represented by broken lines. As a result of the spreading apart of the levers 46 and 47, the sliding block 53 and with it the sliding part 51 together with the slide 37 are moved in the direction of the arrow B. The sliding part 51 thereby moves away from the web 49 along the bearing pins 50 and moves the slide 37 into the gap formed between the dropwire LA' bent outwards and the drop-wire stack LS, specifically as far as the position represented by broken lines. As soon as this is reached, the pivot pin between the lever 46 and the plate 48 is no longer fixed in place, but can move in the direction of the arrow A. The two levers 46 and 47 and the parts carried by them thereby pass into the position represented by broken lines.

During this movement, the slide 37 draws the dropwire ends out of the steps 31, so that the dropwire is freed and is gripped between the slide 37 and an abutment 29 (FIG. 3). The dropwire is then moved by the slide 37, counter to the force of the abutment 29, in the direction of the holding means HM and is transferred to this, in that the abutment releases its grip on the dropwire in the region of the holding means.

With the separation device described, the dropwires can be divided off easily, irrespective of whether they have a burr or whether they are stuck to one another by size residues or by dried-up residues of their coating.

The separation is positive and therefore sure and reliable, and it allows a very high working frequency.

Further advantages are that the dropwire assumes a specific position after the separation, and that the separating travels are small. The separation device consists of few parts, and moreover these need not be extremely accurate; both of these factors have a positive effect on the costs of the separation device.

We claim:

1. Drop-wire separation device for warp drawing-in machines, comprising a dividing-off member for dividing-off a foremost dropwire of a drop-wire stack, the dividing off member comprising separating means which subjects to pressure an end edge of the dropwire to be divided off to thereby bend outwardly the dropwire to be divided off and form a gap between the outwardly bent dropwire and the drop-wire stack, and transport means for entry into the gap formed between the outwardly bent dropwire and the drop-wire stack to transport the dropwire to be divided-off away from remaining dropwires in the stack.

2. Device according to claim 1, including guide means for receiving a drop-wire stack and for guiding the dropwires at end regions of the dropwires, means for displacing the dropwires along the guide means in the direction of the separating means, and a pair of stops which are each positioned to engage one end region of the dropwires for positioning the dropwires relative to the separating means.

3. Device according to claim 2, wherein one of the stops is located closer to the separating means than the other stop the stops being offset relative to one another in the horizontal direction, the stop located closer to the separating means being located in front of the other stop in the direction of displacement of the dropwires.

4. Device according to claim 2, wherein the separating means is formed by a plunger member having an end positioned adjacent the dropwire to be divided off, the plunger member having a stepped projection at its end adjacent to the dropwire to be divided off, said plunger member projecting with said projection into a path of the drop-wire stack to thereby form one of said stops.

5. Device according to claim 4, the plunger member is adapted to be actuable pneumatically, the stepped projection having a stepping depth that is smaller than the thickness of the dropwire to be divided off.

6. Device according to claim 2, wherein the transport means for entry into the gap formed as a result of the outward bending of the dropwire to be divided off includes a knife-like slide.

7. Device according to claim 6, including means for causing the slide to execute a two-stage movement that includes movement in the direction transverse to the drop-wire stack movement in the direction along the drop-wire stack.

8. Device according to claim 7, wherein the slide is mounted on a sliding part, said slide being adapted to enter said gap during the movement in the transverse direction relative to the drop-wire stack and transports the divided-off dropwire away from the drop-wire stack during movement in the longitudinal direction.

9. Device according to claim 8, wherein said sliding part is connected to a sliding block, the divided-off dropwire being guided in its end regions during transport in the longitudinal direction.

10. Device according to claim 7, wherein the means for causing the two-stage movement of the slide includes two levers which are articulated on an adjustable bearing head and pivotable relative to one another, one lever being connected to a plate that is adjustable in the longitudinal direction of the drop-wire stack, the plate carrying the sliding part which is displaceable in the transverse direction, the other lever being connected to the sliding block.

11. Device for dividing-off a dropwire from a dropwire stack in a warp drawing-in machine, comprising a movable plunger mounted on a supporting structure for pressing against one end of a dropwire to be divided-off to bend the dropwire outwardly away from remaining dropwires in the stack and cause formation of a gap between the dropwire and remaining dropwires in the stack, a movable slide positionable in the gap, and means connected to the slide for moving the slide positioned in the gap to cause the slide to transport the dropwire to be divided-off away from the remaining dropwires in the stack.

12. Device according to claim 11, wherein said means for moving the slide includes a pivotally mounted pressure cylinder which also moves the slide into the gap formed between the bent dropwire and remaining dropwires in the stack.

13. Device according to claim 12, wherein said means for moving the slide also includes two levers which are pivotally connected to the pressure cylinder, one of said levers being connected to a slidable block.

14. Device according to claim 13, wherein said movable slide is mounted on a sliding part that is secured to the slidable block.

15. Device according to claim 11, including spaced apart upper and lower guide rails mounted on the supporting structure for receiving the stack of dropwires.

16. Device according to claim 15, including a conveying device for conveying the dropwires along the upper and lower guide rails.

17. Device according to claim 15, wherein the lower guide rail includes a stop for engaging a lower end of the dropwires to assist in stopping movement of the dropwires.

18. Device according to claim 16, wherein said movable plunger includes a stepped engaging nose which engages a top end of the dropwires to assist in stopping movement of the dropwires.

* * * * *